US005079527A

United States Patent [19]

Goldfarb

[11] Patent Number: 5,079,527

[45] Date of Patent: Jan. 7, 1992

[54] RECOMBINANT, IN-PHASE, 3-WAY POWER DIVIDER

[75] Inventor: Marc E. Goldfarb, Atkinson, N.H.

[73] Assignee: Raytheon Company, Lexington, Mass.

[21] Appl. No.: 622,915

[22] Filed: Dec. 6, 1990

[51] Int. Cl.[5] ..... H01P 5/12

[52] U.S. Cl. ..... 333/127; 333/128

[58] Field of Search ..... 333/124, 125, 127, 128

[56] References Cited

U.S. PATENT DOCUMENTS

| | | | |
|---|---|---|---|
| 4,254,386 | 3/1981 | Nemit et al. | 333/128 |
| 4,875,024 | 10/1989 | Roberts | 333/128 X |
| 5,021,755 | 6/1991 | Gustafson | 333/128 |

OTHER PUBLICATIONS

Wilkinson, Ernest J., "An N-Way Hybrid Power Divider*," IRE Transactions on Microwave Theory and Techniques, Jan. 1960, pp. 116-118.

Howe Jr., Harlan, "Simplified Design of High Power, N-Way, In-Phase Power Divider/Combiners," Microwave Journal, pp. 51-53.

Parad, L. I., et al., "Split-Tee Power Divider," IEEE Transactions, pp. 91-95.

*Primary Examiner*—Paul Gensler

*Attorney, Agent, or Firm*—Denis G. Maloney; Richard M. Sharkansky

[57] ABSTRACT

A power divider circuit having an input port and three output ports is described. The circuit includes a first power divider stage having an input port which corresponds to the input of the power divider circuit and a pair of output ports with a first resistor coupled between the pair of output ports of the first stage. The power divider further includes first and second pairs of transmission lines with first ones of said lines of each pair having a first characteristic impedance and second ones of said lines having a second, different characteristic impedance generally equal to half of the characteristic impedance of the first ones of said lines. First ends of each one of the transmission lines of each pair are coupled to a corresponding port of the first power combined stage. Second ends of each of said lines or each pairs are coupled by second and third resistors. Second ends of the second transmission lines of each one of said first and second pairs of transmission lines are also connected together providing the one of the output ports of the power combiner circuit with the other two output ports of the power combiner circuit being provided at second ends of the first transmission lines in each one of said first and second pairs of transmission lines.

1 Claim, 3 Drawing Sheets

RECOMBINANT, IN-PHASE, 3-WAY POWER DIVIDER

BACKGROUND OF THE INVENTION

This invention relates generally to microwave circuits and, more particularly, to microwave power dividers.

As is known in the art, a common circuit employed in many microwave system applications is a so-called in-phase power combiner. Simply speaking, an in-phase power divider is a circuit which takes an input radio frequency signal and provides two or more output signals in-phase and of equal or unequal power in accordance with a particular application. There are many known power divider/combiner circuits, in particular one such circuit is described in an article entitled "An N-way Power Divider" by E. Wilkinson, IEEE Transactions on Microwave Theory and Techniques, MTT-8, No. 1, January 1960, pages 116–118. Described in this article is the so-called Wilkinson power combiner/divider which has applications in many microwave systems. Generally, most power combiner/dividers are even multiple output port types. In order to provide an odd output port type, generally an odd number of transmission line paths are provided to be coupled to a common transmission line path and each of the transmission line paths are balanced with resistors placed between the lines and a floating node. This approach is a three dimensional approach since the use of a floating node requires a non-planar interconnection of the resistors. This approach is not particularly suitable for using microwave strip type integrated circuit fabrication techniques.

An alternative approach to the floating node approach mentioned above, is a planarized approach in which the balanced resistors rather than being placed at floating nodes are disposed in shunt across the arms of each of the output transmission line paths. This so-called planarized power divider, although adaptable for use to provide an odd number of output stages which is fabricated in a common plane, nevertheless, has several drawbacks. For instance, in a microstrip implementation of the planarized power divider, relatively high impedance transmission lines are required and at microwave frequencies these high impedance transmission lines are very narrow strip conductors which are difficult to fabricate. More importantly however, such narrow lines increase the insertion loss of the power divider circuit.

Future applications of these circuits require an approach in which it is relatively easy to provide an unequal power division between one of the branches and which can be easily integrated with monolithic microwave integrated circuit technology. Therefore, the non-planar approach described above is particularly unsuited. Moreover, the circuit should have very good microwave characteristics and thus the high insertion loss and low isolation, as provided by the planarized approach also mentioned above, will be unsuited.

Applications for this type of circuit would include, for example, a wide-band receiver having both amplitude and phase tracking requirements. Such a 3-port in-phase power divider can be used in a local oscillator distribution chain in such a receiver where one channel is used as a calibration channel and is fed at a lower level of local oscillator power thereby permitting more local oscillator power to be provided to the two receiving channels. This would improve the dynamic range of the receiver by maximizing local oscillator power to the signal channels that are being processed in the receiver while still permitting the use of a separate calibration channel.

SUMMARY OF THE INVENTION

In accordance with the present invention, a power divider circuit having an input port and three output ports includes a first transmission line having a first characteristic impedance having a first end coupled to the input line and a first pair of transmission lines each one of the first pair of transmission lines having a second characteristic impedance with a first end of each of said lines coupled to a second end of said first transmission line. The power divider further includes a first resistor coupled between second ends of each one of the first pair of transmission lines. The divider further includes a second pair of transmission lines, a first one having a third characteristic impedance, and a second one of said second pair having a fourth characteristic impedance. A third pair of transmission lines is also provided with a first one of said lines having said third characteristic impedance and a second one of said lines having said fourth characteristic impedance. A second resistor is disposed to couple second ends of each one of said second pair of transmission lines and a third resistor is disposed to couple second ends of each one of said third pair of transmission lines. A third transmission line having a fifth characteristic impedance is connected to a first end of the second resistor and a fourth transmission having a fifth characteristic impedance is coupled to a first end of the third pair of transmission lines. A fifth line having a sixth characteristic impedance is connected to a common connection of said second and third resistors and said second transmission lines of the second and third pairs of transmission lines. With such an arrangement, a power divider which can be fabricated in a common plane and which has improved insertion loss characteristics over a broad range of operating frequencies is provided. The second transmission lines of the second and third pair of transmission lines are selected to have characteristic impedances corresponding to a portion of the characteristic impedance of the first lines of said second and third pair of transmission lines. The second lines are connected at a common node with the connection of the third and fourth resistors. This approach, accordingly, eliminates a resistor between the second lines of the second pair of transmission lines commonly employed in prior devices thus improving the insertion loss characteristics of the circuit over conventional circuits.

BRIEF DESCRIPTION OF THE DRAWINGS

The foregoing features of this invention, as well as the invention itself, may be more fully understood from the following detailed description of the drawings, in which.

DESCRIPTION OF THE PREFERRED EMBODIMENTS

Figure 1:
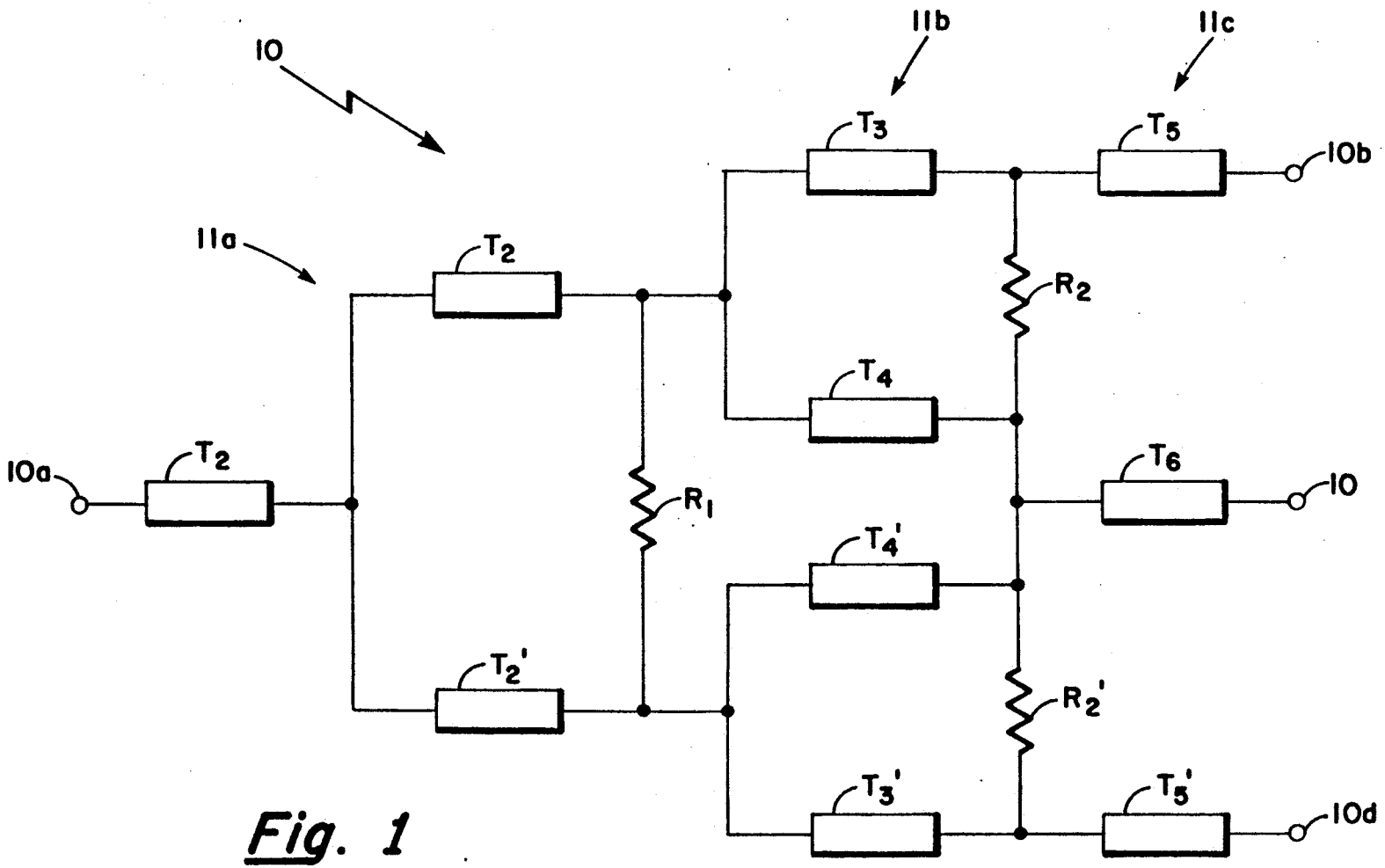
FIG. 1 is a schematic view of a three-way in-phase power divider in accordance with the present invention.

Referring now to FIG. 1, a power divider 10 is shown having an input terminal 10*a* and here three outputs 10*b*–10*d*. Input terminal 10*a* is coupled to a transmission lines $T_1$ having a first impedance characteristic $Z_1$. Transmission line $T_1$ is coupled to a pair of transmission lines $T_2$, $T_2'$ as shown, with each one of said transmission lines having the same characteristic impedance $Z_2$. An isolation resistor $R_1$ is coupled in shunt across transmission lines $T_2$, $T_2'$. A second pair of transmission lines $T_3$, $T_4$ are coupled to one end of resistor $R_1$ and its common connection with transmission line section $T_2$, as shown, and a third pair of transmission lines $T_3'$, $T_4'$ are likewise coupled to here the other end of resistor $R_1$ and its common connection with transmission line section $T_2'$, as also shown. For a balanced, power division between terminals 10*b*, 10*c*, and 10*d*, transmission line sections $T_4$ and $T_4'$ have the same characteristic impedance $Z_4$, and, furthermore here, have a characteristic impedance which is one half the characteristic impedance $Z_3$ of transmission lines $T_3$, $T_3'$. A second isolating resistor $R_2$ is coupled across transmission line sections $T_3$, $T_4$ and a third isolating resistor $R_2'$ is likewise coupled across transmission line section $T_3'$, $T_4'$, as shown. A transmission line $T_5$ having a characteristic impedance of $Z_5$ is coupled between transmission line $T_3$ and output electrode 10*b*. A corresponding transmission line $T_5'$ having a characteristic impedance $Z_5$ is likewise coupled between transmission line $T_3'$ and output terminal 10*d*, as also shown. Transmission line $T_6$ having a characteristic impedance $Z_6$ is coupled between output terminal 10*c* and the common connections to the second ends of transmission lines $T_4$ and $T_4'$, as also shown.

Conceptually, the combiner 10 shown in FIG. 1 has a first stage 11*a* which is a conventional Wilkinson two-port divider having an isolator resistor $R_1$. Each one of the ports, which are the ends of transmission lines $T_2$ and $T_2'$ feed a corresponding one of a pair of modified Wilkinson power combiners which correspond to the second and third pair of transmission lines and corresponding second and third isolating resistors $R_2$ and $R_2'$, as also shown. Here, however, by providing second ones of said transmission lines $T_4$, $T_4'$ having a characteristic impedance equal to a portion of the characteristic impedance of the first ones of said transmission lines $T_3$, $T_3'$ of each pair here such portion being one half of the characteristic impedance and connecting said transmission lines $T_4$, $T_4'$ together, a three-port power combiner is provided without the necessity of floating nodes, and with only three isolating resistors thus improving the insertion loss of the circuit, its bandwidth characteristics and manufacturability of the circuit by having fewer components. The final stage 11*c* of the power combiner 10 has transmission lines $T_5$, $T_5'$, and $T_6$ having selected characteristic impedances which are selected in accordance with the input characteristic impedances of networks coupled to terminals 10*b*–10*d*. Moreover, the power division ratio between ports 10*b*, 10*d* and port 10*c* can be adjusted by changing the impedance characteristic $Z_4$ of transmission lines $T_4$ relative to the characteristic impedance $Z_3$ of transmission line $T_3$ and adjusting the impedances of transmission lines $T_1$, $T_2$, $T_2'$ and $T_5$, $T_5'$, and $T_6$, accordingly, to provide the match indicated above.

Figure 4:
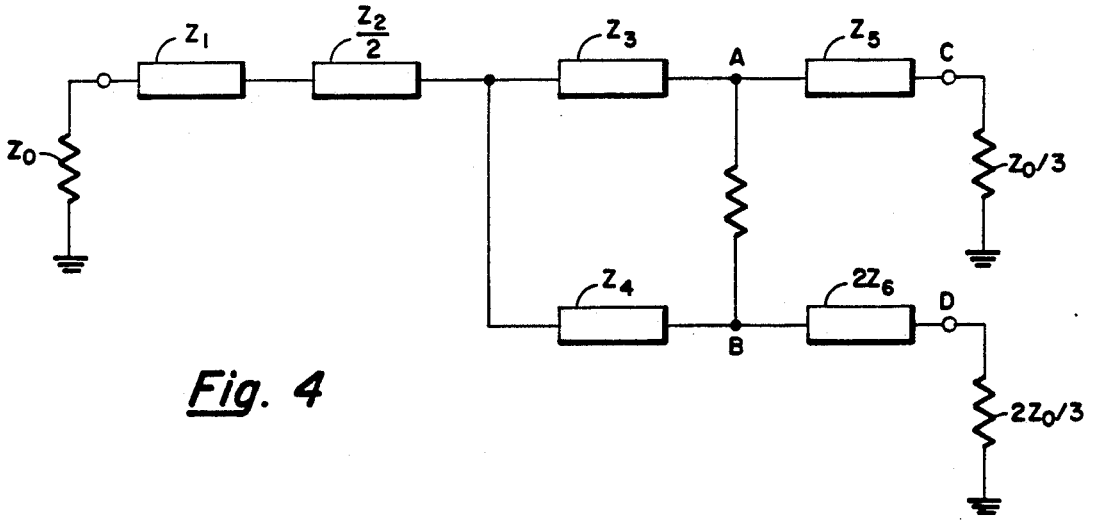
FIG. 4 is a schematic view of an equivalent circuit used to model the power divider of FIG. 1.

To determine the values for the divider elements in a three section divider, an equivalent circuit of the divider is modeled when the divider is excited by equal amplitude, in-phase signals on all three outputs (FIG. 4). Since no dissipation occurs in either of the resistors, points A and B can be connected together as well as points C and D.

Synthesis of a Zo to 2*Zo/9, 0.1 dB ripple, Tchebyscheff transformer is performed resulting in the following normalized impedances:

$$\bar{Z}_1 = .838\,\frac{\bar{Z}_2}{2} = .588\,\frac{\bar{Z}_3 \cdot \bar{Z}_4}{\bar{Z}_3 + \bar{Z}_4} = .378\,\frac{\bar{Z} \cdot 2\bar{Z}_6}{\bar{Z}_5 + 2\bar{Z}_6} = .262$$

The values of impedances $Z_4$ and $Z_3$, in FIG. 1, are related by $K^2$, the power division ratio, as discussed in an article by L. Parad, et al. entitled "A Split Tee Power Divider," IEEE Trans. Microwave Theory and Tech., Vol. MTT-3, No. 1, Jan. 1965, pages 91–95. The synthesis problem is additionally constrained by the following relationships which arise from return loss and symmetry requirements:

$$\frac{Z_1^2}{Z_2^2} \cdot \frac{(K^2 Z_3)^2}{K^4 Z_5^2 + 2Z_6^2} - 1 = 0$$

$$Z_{2out} = \frac{Z_3^2 (K^2 Z_3)^2}{\left(\frac{Z_5^2}{Z_0}\right)\left(\frac{Z_6^2}{Z_0}\right)^2} \cdot \left[\frac{Z_3^2}{\left(\frac{Z_5^2}{Z_0}\right)} + \frac{K^2 Z_5}{\left(\frac{2Z_6^2}{Z_0}\right)}\right]$$

When the constraint equations, above, are applied, it can be shown that the exact synthesis of the power divider is now mathematically overdetermined and, therefore, a numerical solution is more appropriate to determine the optimum circuit values of a particular design requirement.

Thus, by generation of an error function based on the deviation of the device's simulated performance from a design goal as a function of line impedances, electrical length, and isolation resistor values, an optimum design can be provided by successive iterations.

Figure 2:
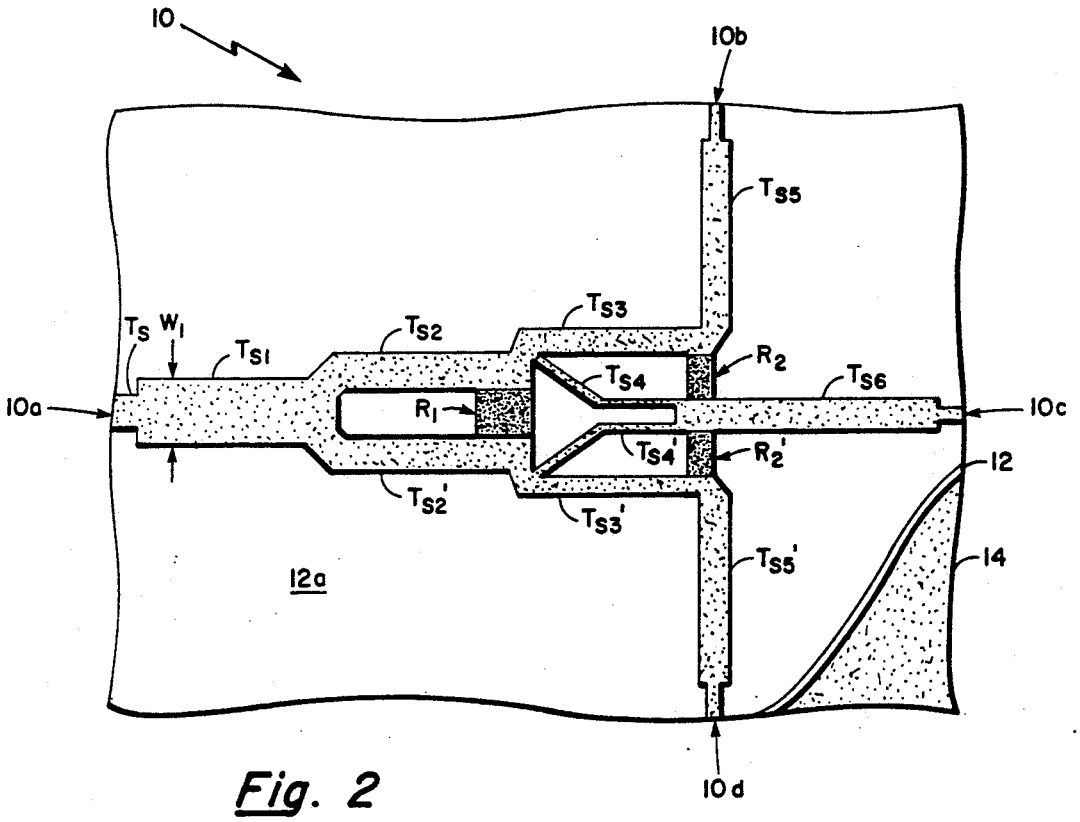
FIG. 2 is a plan view of the power divider shown in FIG. 1.

Referring now to FIG. 2, an implementation of the power combiner, as shown in FIG. 1, is shown to include a substrate 12 comprised of a suitable dielectric material such as gallium arsenide, alumina, and so forth which is suitable for use as a dielectric at microwave frequencies. Disposed over a first surface 12*a* of the substrate 12 are patterned strip conductors as will be described below to provide the power divider 10. Disposed over a second opposite surface of substrate 12 is a ground plane conductor 14. On surface 12*a* of substrate 12 is provided a strip conductor $T_S$ which corresponds to a microstrip transmission line having a system characteristic impedance of typically 50 ohms which feeds an input signal into the power divider 10. The power divider 10 includes a first strip conductor $T_{S1}$ having a first characteristic impedance $Z_1$ which is determined in accordance with the dielectric properties of substrate 12, a thickness of substrate 12, and the width $W_1$ of strip conductor $T_{S1}$ as is known to one of skill in the art. Likewise, for the strip conductors to be disposed over surface 12*a*, each one of said strip conductors will have corresponding widths to provide selected characteristic impedances for the transmission lines as would also be known to one of skill in the art.

Strip conductor $T_{S1}$ is coupled to a pair of strip conductors $T_{S2}$ and $T_{S2}'$ each having widths $W_2$ to provide corresponding impedance characteristics $Z_2$. Second ends of strip conductors $T_{S2}$ are connected to a resistor $R_1$ here a tantalum nitride resistor having a width selected in accordance with the resistivity of the tantalum nitride to provide a selected resistance value for resistor $R_1$. The tantalum nitride layer of resistor $R_1$ has portions disposed under strip conductors $T_{S2}$, $T_{S2}'$ to make electrical contact to the tantalum nitride layer and thus provide the resistor $R_1$. Strip conductor $T_{S2}$ and $T_{S2}'$ are likewise coupled to strip conductors $T_{S3}$, $T_{S4}$, $T_4'$ and $T_{S3}'$, respectively as shown. Second ends of strip conductors $T_{S3}$, $T_{S3}'$ are connected to strip conductors $T_{S5}$ and $T_{S5}'$ and thus onto ports 10*b* and 10*d*, as shown, whereas ends of strip conductors $T_{S4}$ and $T_{S4}'$ are connected to a common strip conductor $T_{S6}$ which is coupled to the third branch port 10*c*, as also shown. Second and third isolation resistors $R_2$ and $R_2'$ are connected between strip conductors $T_{S5}$ and $T_{S5}'$ and $T_{S6}$, as also shown. As for resistor $R_1$, resistors $R_2$ and $R_2'$ are likewise provided by a layer of tantalum nitride having portions disposed under respective strip conductors to make electrical contact to the resistors.

As an illustrative example, a three-way power divider operative over a band centered at 10 gigahertz was designed to be fabricated over a 25 mil thick substrate comprised of aluminum oxide (alumina). To improve device yield and minimize insertion loss, a constraint was placed on the design that the highest impedance of any transmission line would be 80 ohms. For the thickness of the substrate at the frequency of 10 gigahertz, this constraint provides a minimum line width for the strip conductors of approximately 4 mils (100 micrometers). Table 1, below, gives the impedances for each of the elements shown in FIG. 1. All of the line lengths are approximately a quarter wavelength long at 10 GHz.

TABLE 1

| Transmission Line | Impedance |
|---|---|
| $T_1$ | 36 ohms |
| $T_2$, $T_2'$ | 40 ohms |
| $T_3$, $T_3'$ | 40 ohms |
| $T_4$, $T_4'$ | 80 ohms |
| $T_5$, $T_5'$ | 40 ohms |
| $T_6$ | 40 ohms |
| $R_1$ | 50 ohms |
| $R_2$ | 100 ohms |
| $R_3$ | 100 ohms |

Figure 3B:
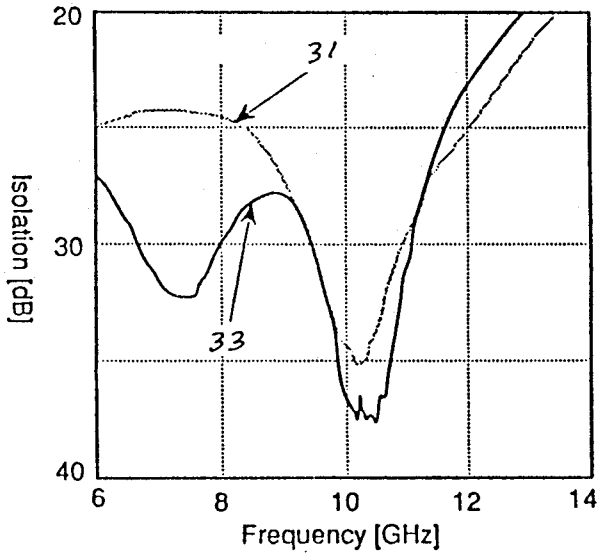
FIGS. 3A–3C are plots of theoretical electrical characteristics of the circuit as functions of frequency.
Figure 3A:
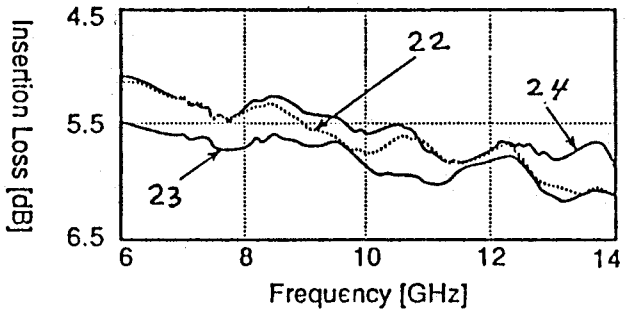

FIGS. 3A-3D illustrate theoretical expected characteristics for the design set forth in the Table. FIG. 3A shows the insertion loss of the power combiner over the frequency range of 6–14 gigahertz. The insertion loss of ports 10*b* and 10*d* curves 22 and 24, respectively are substantially identical, whereas that of port 10*c* (curve 23), the recombined port is approximately 0.5 dB higher generally over the frequency range of 6–14 gigahertz. Improvement of this insertion loss characteristic would be provided by repeating the fabrication of this device with the different impedances for transmission line $T_4$, $T_4'$.

Figure 3C:
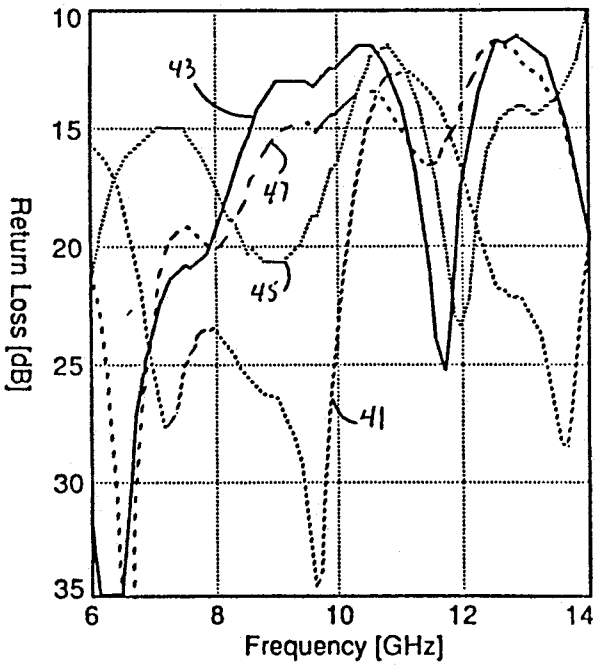

FIG. 3B shows the port-to-port isolation of the power combiner design set for in Table 1. Curve 31 shows the isolation characteristic between ports 10*b* and 10*c* whereas curve 33 shows the isolation characteristic between ports 10*b* and 10*d*. Over the frequency range of 6–13 gigahertz the isolation is better than 20 dB. FIG. 3C shows the return loss at each port of the power combiner over the frequency range of 6–14 gigahertz. Curves 41, 43, 45, and 47 correspond to the return loss at ports 10*a*, 10*b*, 10*c*, and 10*d*, respectively. The return loss is a measure of the mismatch at each one of the ports.

Having described preferred embodiments of the invention, it will now become apparent to one of skill in the art that other embodiments incorporating their concepts may be used. It is felt, therefore, that these embodiments should not be limited to disclosed embodiments, but rather should be limited only by the spirit and scope of the appended claims.

What is claimed is:

1. A power divider circuit having an input port and three output ports comprising:

a first transmission line having a first characteristic impedance having a first end coupled to the input part;

a first pair of transmission lines each one of the first pair of transmission lines having a second characteristic impedance with a first end of each of said lines coupled to a second end of said first transmission line;

a first resistor coupled between second ends of each one of the first pair of transmission lines;

a second pair of transmission lines each having first ends coupled to a first end of the first resistor with a first one having a third characteristic impedance, and a second one of said second pair having a fourth characteristic impedance;

a third pair of transmission lines each having first ends coupled to a second end of the first resistor with a first one of said lines having said third characteristic impedance and a second one of said lines having said fourth characteristic impedance;

a second resistor disposed to couple second ends of each one of said second pair of transmission lines;

a third resistor is disposed to couple second ends of each one of said third pair of transmission lines;

a second transmission line having a fifth characteristic impedance coupled between a first one of the output ports and the end of the second resistor connected to the first transmission line of the second pair of transmission lines;

a third transmission line having said fifth characteristic impedance coupled between a second one of the output ports and the end of the third resistor connected to the first transmission line of the third pair of transmission lines; and a fourth transmission line having a sixth characteristic impedance connected between a third one of the output ports and a common connection of said second and third resistors and said second transmission lines of the second and third pairs of transmission lines.

* * * * *